US009868919B2

(12) United States Patent
Delbridge et al.

(10) Patent No.: US 9,868,919 B2
(45) Date of Patent: Jan. 16, 2018

(54) LUBRICATING COMPOSITION CONTAINING LEWIS ACID REACTION PRODUCT

(71) Applicant: The Lubrizol Corporation, Wickliffe, OH (US)

(72) Inventors: Ewan E. Delbridge, Concord Township, OH (US); Yanshi Zhang, Solon, OH (US); Jody A. Kocsis, Chagrin Falls, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 14/774,733

(22) PCT Filed: Mar. 5, 2014

(86) PCT No.: PCT/US2014/020470

§ 371 (c)(1),
(2) Date: Sep. 11, 2015

(87) PCT Pub. No.: WO2014/164087

PCT Pub. Date: Oct. 9, 2014

(65) Prior Publication Data

US 2016/0024420 A1 Jan. 28, 2016

Related U.S. Application Data

(60) Provisional application No. 61/777,420, filed on Mar. 12, 2013.

(51) Int. Cl.

| | |
|---|---|
| ***C10M 159/12*** | (2006.01) |
| ***C10M 161/00*** | (2006.01) |
| ***C10M 159/18*** | (2006.01) |
| ***C10M 159/20*** | (2006.01) |

(52) U.S. Cl.

CPC ..... *C10M 161/00* (2013.01); *C10M 159/12* (2013.01); *C10M 159/18* (2013.01); *C10M 159/20* (2013.01); *C10M 2203/1025* (2013.01); *C10M 2207/026* (2013.01); *C10M 2215/28* (2013.01); *C10M 2219/022* (2013.01); *C10M 2219/066* (2013.01); *C10M 2223/045* (2013.01); *C10M 2227/061* (2013.01); *C10M 2227/065* (2013.01); *C10M 2227/09* (2013.01); *C10N 2210/02* (2013.01); *C10N 2230/04* (2013.01); *C10N 2230/10* (2013.01); *C10N 2230/12* (2013.01); *C10N 2230/42* (2013.01); *C10N 2230/43* (2013.01); *C10N 2240/10* (2013.01)

(58) Field of Classification Search

CPC ..... C10M 161/00; C10M 159/20; C10M 159/12; C10M 2227/061; C10M 2227/065; C10M 2207/026; C10M 2219/066; C10M 2203/1025; C10M 2223/045; C10M 2219/022; C10M 2215/28; C10M 2227/09; C10N 2230/10; C10N 2230/04; C10N 2230/43; C10N 2240/10; C10N 2230/12; C10N 2210/02; C10N 2230/42

See application file for complete search history.

(56) References Cited

U.S. PATENT DOCUMENTS

| | | | | |
|---|---|---|---|---|
| 2,620,302 | A | 12/1952 | Harle et al. | |
| 2,620,304 | A | 12/1952 | Stewart et al. | |
| 2,620,305 | A | 12/1952 | Stewart et al. | |
| 2,681,315 | A | 6/1954 | Tongberg et al. | |
| 2,833,717 | A | 5/1958 | Tongbert et al. | |
| 2,921,027 | A | 1/1960 | Brennan et al. | |
| 3,625,889 | A | 12/1971 | Sawyer et al. | |
| 3,933,662 | A | 1/1976 | Lowe et al. | |
| 4,051,053 | A * | 9/1977 | Elliott | C07F 7/045 252/78.3 |
| RE30,698 | E * | 8/1981 | Elliott | C07F 7/045 252/78.3 |
| 4,305,835 | A | 12/1981 | Barber et al. | |
| 4,402,845 | A | 9/1983 | Zoleski et al. | |
| 4,438,005 | A | 3/1984 | Zoleski et al. | |
| 4,479,882 | A | 10/1984 | Zoleski et al. | |
| 4,486,323 | A | 12/1984 | Horodysky et al. | |
| 4,493,776 | A | 1/1985 | Rhodes et al. | |
| 4,973,414 | A | 11/1990 | Nerger et al. | |
| 5,094,768 | A | 3/1992 | Jolley et al. | |
| 5,397,486 | A | 3/1995 | Small et al. | |
| 2009/0099048 | A1 | 4/2009 | Zhao et al. | |
| 2011/0239970 | A1 | 10/2011 | Nelson et al. | |
| 2014/0045736 | A1* | 2/2014 | Crawley | C10M 141/08 508/282 |

FOREIGN PATENT DOCUMENTS

| | | | | |
|---|---|---|---|---|
| CN | 102861102 | | 1/2013 | |
| EP | 0129240 | A1 | 12/1984 | |
| EP | 1257623 | A1 | 11/2002 | |
| JP | S53105676 | A | 9/1978 | |
| JP | H03122193 | A | 5/1991 | |
| WO | 9013618 | A1 | 11/1990 | |
| WO | WO 2012158595 | A1 * | 11/2012 | C10M 141/08 |

* cited by examiner

*Primary Examiner* — Taiwo Oladapo

(74) *Attorney, Agent, or Firm* — Iken S. Sans; Teresan W. Gilbert

(57) ABSTRACT

The invention provides a lubricating composition comprising: an oil of lubricating viscosity and a reaction product of a monovalent to tetravalent inorganic Lewis acid and a hydroxyl terminated polyether (or glycol), wherein the mole ratio of hydroxyl terminated polyether (or glycol) to Lewis acid is 1:1 or greater. The invention further relates to a method of lubricating a mechanical device (such as an internal combustion engine) with the lubricating composition.

15 Claims, No Drawings

LUBRICATING COMPOSITION CONTAINING LEWIS ACID REACTION PRODUCT

CROSS REFERENCE TO RELATED APPLICATION

This application claims priority from PCT Application Serial No. PCT/US2014/020470 filed on Mar. 5, 2014, which claims the benefit of U.S. Provisional Application No. 61/777,420 filed on Mar. 12, 2013.

FIELD OF INVENTION

The invention provides a lubricating composition comprising: an oil of lubricating viscosity and a reaction product of a monovalent to tetravalent inorganic Lewis acid and a hydroxyl terminated polyether (or glycol), wherein the mole ratio of hydroxyl terminated polyether (or glycol) to Lewis acid is 1:1 or greater. The invention further relates to a method of lubricating a mechanical device (such as an internal combustion engine) with the lubricating composition.

BACKGROUND OF THE INVENTION

It is well known for lubricating oils to contain a number of surface active additives (including antiwear agents, dispersants, or detergents) used to protect internal combustion engines from corrosion, wear, soot deposits, sludge deposits, and acid build up. Often, such surface active additives can have harmful effects on engine component wear (in both iron and aluminium based components), bearing corrosion or fuel economy. A common antiwear additive for engine lubricating oils is zinc dialkyldithiophosphate (ZDDP). It is believed that ZDDP antiwear additives protect the engine by forming a protective film on metal surfaces. ZDDP may also have a detrimental impact on fuel economy and efficiency and copper corrosion. Consequently, engine lubricants may also contain a friction modifier to obviate the detrimental impact of ZDDP on fuel economy and corrosion inhibitors to obviate the detrimental impact of ZDDP on copper corrosion. Friction modifiers and other additives may also increase lead corrosion.

Further, engine lubricants containing phosphorus and sulphur compounds such as ZDDP have been shown to contribute in part to particulate emissions and emissions of other pollutants. In addition, sulphur and phosphorus tend to poison the catalysts used in catalytic converters, resulting in a reduction in performance of said catalysts.

There has been a commercial trend for reduction in emissions (typically reduction of NOx formation, SOx formation) and a reduction in sulphated ash in engine oil lubricants. Consequently, the amounts of phosphorus-containing antiwear agents such as ZDDP, overbased detergents such as calcium or magnesium sulphonates and phenates have been reduced. As a consequence, ashless additives have been contemplated to provide friction or antiwear performance. It is known that surface active ashless compounds such as ashless friction modifiers may in some instances increase corrosion of metal, namely, copper or lead. Copper and lead corrosion may be from bearings and other metal engine components derived from alloys using copper or lead.

U.S. Pat. No. 3,933,662 (Lowe, published 20 Jan. 1976) discloses mono-ester polyalkoxylated compounds combined with alkaline earth metal carbonates dispersed in a hydrocarbon medium to provide lubricating compositions of superior acid neutralizing capability and rust inhibition in internal combustion engines. The internal combustion engine was tested using a Sequence IIB engine test. The Sequence IIB engine test evaluates valve guide rust and pitting.

U.S. Pat. No. 4,305,835 (Barber et al, published 15 Dec. 1981) discloses lubricating oil composition for use in the crankcase of an internal combustion engine, having improved resistance to the formation of emulsion-sludge in the area under the engine rocker cover, which contains the combination of an oxyalkylated alkylphenol-formaldehyde condensation product and an oxyalkylated trimethylolalkane.

U.S. Pat. No. 4,402,845 (Zoleski et al., published 6 Sep. 1983) discloses improved spreadability of marine diesel cylinder oils by the incorporation therein of a polyethylene glycol of the formula: $R—CH_2O—(CH_2CH_2O)_nH$ wherein n ranges from 7 to 40 and R is an alkyl group containing from 11 to 15 carbon atoms.

U.S. Pat. No. 4,438,005 (Zoleski et al., published 20 Mar. 1984) discloses improved spreadability of marine diesel engine cylinder lubricants by the incorporation therein of a spreadability improving amount of at least one polyoxyethylene ester of the formula: wherein n ranges from 18 to 22 and R is an alkyl group having 11 to 17 carbon atoms in the chain.

U.S. Pat. No. 4,479,882 (Zoleski et al., published 30 Oct. 1984) discloses improved spreadability of marine diesel cylinder oils by the incorporation therein of a spreadability improving amount of a polyalkoxylated phenoxy compound having the formula: wherein R is an aliphatic hydrocarbyl group having from 5 to 70 carbon atoms and n ranges from 14 to 30.

U.S. Pat. No. 4,493,776 (Rhodes, published 15 Jan. 1985) discloses a lubricating composition with improved rust and corrosion inhibition comprising an additive that is a combination of (A) $R^1O[C_2H_4O]_xH$ and/or $R^2O[C_3H_6O]_yH$ with (B) $R^3O[C_2H_4O]_x[C_3H_6O]_yH$ and/or $R^4O[C_3H_6O]_y[C_2H_4O]_xH$, wherein $R^1$, $R^2$, $R^3$ and $R^4$ are hydrocarbyl radicals selected from alkyl, aryl, alkaryl, and arylalkyl groups or combinations thereof having from about 10 to about 24 carbon atoms; and wherein x and y may vary independently in the range from 3 to about 15. The additives are hydroxyl-terminated.

U.S. Pat. No. 4,973,414 (Nerger et al., published 27 Nov. 1990) discloses monofunctional polyethers having hydroxyl groups contain, as built-in terminal groups or monomers, (a) 1 to 30% by weight of one or more C4- to C24-alkylmonophenols, (b) 1 to 30% by weight of one or more C8- to C24-monoalkanols, (c) 1 to 30% by weight of one or more C10- to C20-1,2-epoxyalkanes and (d) 45 to 80% by weight of propylene oxide or a lower alkylene oxide mixture consisting mainly of propylene oxide the sum of components (a) to (d) adding up to 100% by weight, and have average molecular weights of 600 to 2,500.

U.S. Pat. No. 5,397,486 (Small, published 14 Mar. 1995) discloses a method for inhibiting wear of silver wrist-pin bearings in a two-cycle railroad diesel engine which method comprises lubricating the internal portion thereof with a lubricating oil composition consisting essentially of: a single or multi-grade oil of lubricating viscosity; a sufficient amount of a calcium overbased sulfurized alkylphenate composition so that the total base number in the lubricating oil composition is from about 5 to about 30; and a wear-inhibiting amount of at least one lubricating oil soluble and compatible compound based upon a hydroxy-terminated polyether having 2 to 6 carbon atoms.

Polyalkoxylated compounds are also disclosed in U.S. Pat. No. 2,681,315 (Tongberg, published 15 Jun. 1954) and U.S. Pat. No. 2,833,717 (Whitacre, published 6 May 1958) teaching lubricating oil compositions containing poly(oxyethylene)alkylphenols useful as rust or corrosion-inhibiting additives.

U.S. Pat. No. 2,921,027 (Brennan 12 Jan. 1960) teaches poly(oxyethylene)sorbitan fatty acid ester as a rust inhibitor.

1,2-poly(oxyalkylene)glycol lubricating compositions are disclosed in U.S. Pat. No. 2,620,302 (Harle, published 2 Dec. 1952), U.S. Pat. No. 2,620,304 (Stewart et al., published 2 Dec. 1952), and U.S. Pat. No. 2,620,305 (Stewart et al., published 2 Dec. 1952).

SUMMARY OF THE INVENTION

The objectives of the present invention include providing a lubricating composition having at least one of the following properties (i) improved sludge handling, (ii) reduced lead or copper corrosion, (iii) increased oxidation resistance, (iv) improved acid control, (v) reduced wear (such as cam wear or lifter wear), (vi) retention of total base number of the lubricant, (vii) decreased deposit formation, and/or (viii) improved seal compatibility in the operation of an internal combustion engine. For example, the objectives of the present invention may include providing at least one of (i) improved sludge handling, (ii) reduced lead or copper corrosion, (iii) increased oxidation resistance, and/or (iv) decreased deposit formation.

As used herein, reference to the amounts of additives present in the lubricating composition disclosed are quoted on an oil free basis, i.e., amount of actives, unless otherwise indicated.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the basic and novel characteristics of the composition or method under consideration.

When used herein, the phrase "(or glycol)" following, for example, reference to a hydroxyl terminated compound, such as in the phrase, "hydroxyl terminated polyether (or glycol)", or an oxide compound, such as in the phrase "polyalkylene oxide (or glycol)", means and includes respectively, the polyether glycol and the polyakylene glycol.

In one embodiment the present invention provides a lubricating composition comprising: an oil of lubricating viscosity and a reaction product of a monovalent to tetravalent inorganic Lewis acid and a hydroxyl terminated polyether (or glycol, or polyalkylene oxide), wherein the mole ratio of hydroxyl terminated polyether (or glycol) to Lewis acid is 1:1 or greater, wherein the lubricating composition is not a grease.

In another embodiment the present invention provides a lubricating composition comprising: an oil of lubricating viscosity, 0.05 wt % to 2 wt % of a reaction product of a monovalent to tetravalent inorganic Lewis acid and a hydroxyl terminated polyether (or glycol), wherein the mole ratio of hydroxyl terminated polyether (or glycol) to Lewis acid is 1:1 or greater.

In still another embodiment the present invention provides a lubricating composition comprising: an oil of lubricating viscosity, a reaction product of a monovalent to tetravalent inorganic Lewis acid and a hydroxyl terminated polyether (or glycol), wherein the mole ratio of hydroxyl terminated polyether (or glycol) to Lewis acid is 1:1 or greater, and a corrosion inhibitor, wherein the lubricating composition is not a grease.

In a further embodiment the present invention provides a lubricating composition comprising: an oil of lubricating viscosity, 0.01 wt % to 2 wt % of a reaction product of a monovalent to tetravalent inorganic Lewis acid and a hydroxyl terminated polyether (or glycol), wherein the mole ratio of hydroxyl terminated polyether (or glycol) to Lewis acid is 1:1 or greater, and 0.01 wt % to 2 wt % of a corrosion inhibitor, wherein the lubricating composition is not a grease.

In a still further embodiment the present invention provides a lubricating composition comprising: an oil of lubricating viscosity, 0.1 wt % to 1 wt % of a reaction product of a monovalent to tetravalent inorganic Lewis acid and a hydroxyl terminated polyether (or glycol), wherein the mole ratio of hydroxyl terminated polyether (or glycol) to Lewis acid is 1:1 or greater, and 0.1 wt % to 1 wt % of a corrosion inhibitor.

In an additional embodiment the present invention provides a lubricating composition comprising: an oil of lubricating viscosity, a reaction product of a monovalent to tetravalent inorganic Lewis acid and a hydroxyl terminated polyether (or glycol), wherein the mole ratio of hydroxyl terminated polyether (or glycol) to Lewis acid is 1:1 or greater, a corrosion inhibitor, and an overbased detergent, wherein the lubricating composition is not a grease.

According to NLGI (National Lubricating Grease Institute) a grease is defined as "a solid to semi-solid product of dispersion of a thickening agent in a liquid lubricant. Additives imparting special properties may be included." The NLGI is the international technical trade association that serves the lubricating grease and gear lubricant industry. A grease is not within the scope of the present invention. A grease has a kinematic viscosity measured at 100° C. significantly in excess of 50 $mm^2/s$ as measured by ATSM D445-12. In contrast, the lubricating composition of the present invention will have an inherent kinematic viscosity at 100° C. as measured by ATSM D445-12 of less than 50 $mm^2/s$, typically 2 $mm^2/s$ to 25 $mm^2/s$, or 3 $mm^2/s$ to 20 $mm^2/s$, or 3.5 $mm^2/s$ to 18 $mm^2/s$. For example a passenger car lubricating composition may have a kinematic viscosity at 100° C. of 6 $mm^2/s$ to 12 $mm^2/s$; and a heavy duty diesel lubricating composition may have a kinematic viscosity at 100° C. of 10 $mm^2/s$ to 18 $mm^2/s$.

A grease is also known in the art to be defined as "a lubricant which has been thickened in order that it remain in contact with the moving surfaces and not leak out under gravity or centrifugal action, or be squeezed out under pressure". This description is presented by Dr. Gareth Fish as a well-known definition of a grease at the NLGI Annual Meeting, 9-12 Jun. 2012. The presentation by Dr. Fish is entitled "Basic Grease Course Overview & Introduction to Greases" and is part of the established NLGI Grease Education Program that is incorporated into the NLGI Annual Meeting.

In one embodiment the lubricating composition defined by the invention is not an emulsion. An emulsion is defined as a colloidal suspension of one immiscible liquid in another, e.g., a water-in-oil, or oil-in-water emulsion.

In another embodiment the lubricating composition defined by the invention is substantially free of, to free of water. By substantially free of, to free of water it is meant that the lubricating composition contains less than 5 wt % water, or less than 1 wt % water, or less than 0.5 wt % water, or less than 0.1 wt % water. Typically any water present may be considered a contaminant amount typically 0 ppb, to less than 500 ppm. Contaminant amounts of water may be present as a result of leakage during internal combustion engine use, or as a result of impurities remaining before, during or after preparation of the Newtonian lubricating composition.

The lubricating composition may have a SAE viscosity grade of XW—Y, wherein X may be 0, 5, 10, or 15; and Y may be 20, 30, or 40.

In another embodiment the invention provides a lubricating composition characterised as having at least one of (i) a sulphur content of 0.2 wt % to 0.4 wt % or less, (ii) a phosphorus content of 0.08 wt % to 0.15 wt %, and (iii) a sulphated ash content of 0.5 wt % to 1.5 wt % or less.

In a further embodiment the invention provides a lubricating composition characterised as having (i) a sulphur content of 0.5 wt % or less, (ii) a phosphorus content of 0.1 wt % or less, and (iii) a sulphated ash content of 0.5 wt % to 1.5 wt % or less.

In still another embodiment the invention provides a method of lubricating an internal combustion engine comprising supplying to the internal combustion engine a lubricating composition disclosed herein.

The internal combustion engine may have a steel surface on a cylinder bore, a cylinder block, or a piston ring.

The internal combustion engine may be a heavy duty diesel internal combustion engine.

The heavy duty diesel internal combustion engine may have a "technically permissible maximum laden mass" over 3,500 kg. The engine may be a compression ignition engine or a positive ignition natural gas (NG) or LPG (liquefied petroleum gas) engine. The internal combustion engine may be a passenger car internal combustion engine. The passenger car engine may be operated on unleaded gasoline. Unleaded gasoline is well known in the art and is defined by British Standard BS EN 228:2008 (entitled "Automotive Fuels—Unleaded Petrol—Requirements and Test Methods").

The passenger car internal combustion engine may have a reference mass not exceeding 2610 kg.

In one embodiment the invention provides for the use of reaction product of a monovalent to tetravalent inorganic Lewis acid and a hydroxyl terminated polyether (or glycol), wherein the mole ratio of hydroxyl terminated polyether (or glycol) to Lewis acid is 1:1 or greater in a lubricating composition disclosed herein to provide at least one of (i) improved sludge handling, (ii) reduced lead or copper corrosion, (iii) increased oxidation resistance, and/or (iv) decreased deposit formation in an internal combustion engine.

DETAILED DESCRIPTION OF THE INVENTION

The present invention provides a lubricating composition, a method for lubricating an internal combustion engine and the use as disclosed above.

The reaction product component of the lubricating composition comprises a monovalent to tetravalent inorganic Lewis acid and a hydroxyl terminated polyether (or glycol), wherein the mole ratio of hydroxyl terminated polyether (or glycol) to Lewis acid is 1:1 or greater (or 1:1 to 1:4, or 1:1.05 to 1:4, or 1:2 to 1:4, or 1.3 to 1.4) which may be obtained/obtainable by reacting a Lewis acid with a hydroxyl-terminated polyether (or glycol). Without being bound by theory, it is believed that the Lewis acid adduct comprises a Lewis acid-oxygen covalent bond, wherein the oxygen comes from a hydroxyl terminated polyether (or glycol).

In another embodiment of the present invention the reaction product comprises a monovalent to tetravalent inorganic Lewis acid and a hydroxyl terminated polyether (or glycol) is a compound characterized as having at least one covalent or dative bond between said Lewis acid and at least one oxygen atom of the polyalkylene oxide (or glycol). A covalent bond is typically one wherein both atoms of the bond contribute at least one electron to the bond and the bonding electrons are "shared." A dative (or coordination) bond is characterized as involving one species (the Lewis base) sharing it's bonding electron pair unequally with the Lewis acid, often a cationic metal.

The invention reaction product may be prepared by reacting the inorganic Lewis acid to polyether (or glycol) at a temperature in the range of 20° C. to 300° C., or 50° C. to 250° C., or 100° C. to 200° C.

The reaction may be prepared in the absence or presence of solvent. The solvent may be aromatic or non-aromatic.

Examples of an aromatic (hydrocarbon) solvent include Shellsolv AB® (commercially available from Shell Chemical Company); and toluene extract, Aromatic 200, Aromatic 150, Aromatic 100, Solvesso 200, Solvesso 150, Solvesso 100, HAN 857® (all commercially available from Exxon Chemical Company), or mixtures thereof. Other aromatic hydrocarbon solvents include xylene, toluene, or mixtures thereof.

The reaction may take place in air, or an inert atmosphere (for example under nitrogen or argon).

Lewis Acid

The inorganic Lewis acid may be divalent to tetravalent. For example, the inorganic Lewis acid is trivalent to pentavalent (or tetravalent). In one embodiment the inorganic Lewis acid is trivalent. In one embodiment the inorganic Lewis acid is tetravalent. The inorganic Lewis acid may comprise a trivalent or tetravalent D-block transition metal. The D-block transition metal may be from the fourth fifth or sixth period of the periodic table, for example, titanium, chromium, iron, copper, or zinc. In one embodiment the D-block transition metal may be titanium, or zinc, typically titanium.

The inorganic Lewis acid may comprise a trivalent or tetravalent P-block Group III or P-Block Group IV element. The P-block Group III or P-Block Group IV element may include boron, aluminum, or silicon, typically boron.

Examples of the inorganic Lewis acid include boric acid, $BF_3$, $BCl_3$, $TiCl_4$, $Ti(OH)_4$, low molecular weight borate ester $B(OR)_3$ or titanium alkoxide $Ti(OR)_4$ or $ZnCl_2$. The low molecular weight borate ester $B(OR)_3$ or titanium alkoxide $Ti(OR)_4$ may have R groups containing 1 to 10 carbon atom, or 1 to 5 carbon atom hydrocarbyl groups (such as methyl, ethyl, propyl, isopropyl, butyl sec-butyl, or tert-butyl). In a different embodiment the inorganic Lewis acid may include boric acid or $Ti(OH)_4$.

Polyether (or Glycol)

The reaction product may be present in the lubricating composition in an amount of 0.01 wt % to 5 wt %, or 0.05 wt % to 2 wt %, or 0.1 wt % to 1 wt % of the lubricating composition.

The number average molecular weight of the hydroxyl terminated polyether (or glycol) may vary from 150 to 10,000, or 200 to 10,000, or 300 to 8,000, or 500 to 5000.

The hydroxyl terminated polyether (or glycol) is typically hydroxyl terminated polyether (or glycol). The hydroxyl terminated polyether (or glycol) may be a homopolymer or a copolymer, typically a copolymer.

The hydroxyl terminated polyether (or glycol) or may be hydroxyl-terminated at one end and either ether or ester terminated at the other end of the polyether chain.

The hydroxyl terminated polyether (or glycol) is a copolymer according to Formula I:

Formula I

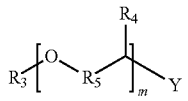

wherein:

$R_3$ may be hydrogen (H), —$R_6$OH, —$R_6NH_2$, —(C═O)$R_6$, —$R_6$—N(H)C(═O)$R_6$, or a hydrocarbyl group of from 1 to 30, or 1 to 20, or 1 to 15 carbon atoms, each $R_4$ may be independently selected from H, or a hydrocarbyl group of from 1 to 10 carbon atoms, each $R_5$ may be independently selected from a straight or branched hydrocarbyl group of from 1 to 6 carbon atoms, $R_6$ may be a hydrocarbyl group of 1 to 20 carbon atoms, Y may be —$NR_7R_8$, —OH, —$R_6NH_2$ or —$R_6$OH, $R_7$, and $R_8$, independently, may be H, or a hydrocarbyl group of from 1 to 50 carbon atoms in which up to one third of the carbon atoms may be substituted by N or functionalized with additional polyether of Formula I, and m may be an integer from 2 to 50, 3 to 40, or 5 to 30, or 10 to 25, with the proviso that at least one of $R_3$ or Y is selected to form a hydroxyl group (i.e., at least one of $R_3$ is H, or Y is —OH). Typically only one of $R_3$ or Y forms a hydroxyl group i.e., the hydroxyl terminated polyether is monohydroxyl-terminated.

In one embodiment the hydroxyl terminated polyether (or glycol) comprises (i) a portion of oxyalkylene groups derived from ethylene oxide; and (ii) a portion of oxyalkylene groups derived from an alkylene oxide containing 3 to 8 carbon atoms.

In one embodiment the hydroxyl terminated polyether (or glycol) is a homopolymer of ethylene oxide.

In another embodiment the hydroxyl terminated polyether (or glycol) comprises (i) 0.1 wt % to 80 wt % of ethylene oxide, and an alkylene oxide containing 3 to 8 carbon atoms present at 20 wt % to 99.9 wt % of the polyoxyalkylene glycol.

In still another embodiment the oil-soluble hydroxyl terminated polyether (or glycol) comprises (i) 5 wt % to 60 wt % of ethylene oxide, and an alkylene oxide containing 3 to 8 carbon atoms present at 40 wt % to 95 wt % of the polyoxyalkylene glycol.

In a further embodiment the oil-soluble hydroxyl terminated polyether (or glycol) comprises (i) 0 wt % to 40 wt % of ethylene oxide, and an alkylene oxide containing 3 to 8 carbon atoms present at 60 wt % to 100 wt % of the polyoxyalkylene glycol.

In a still further embodiment the oil-soluble hydroxyl terminated polyether (or glycol) comprises (i) 0 wt % to 20 wt % of ethylene oxide, and an alkylene oxide containing 3 to 8 carbon atoms present at 80 wt % to 100 wt % of the polyoxyalkylene glycol.

In another embodiment the oil-soluble hydroxyl terminated polyether (or glycol) is a homopolymer of polypropylene glycol.

In still another embodiment the oil soluble hydroxyl terminated polyether (or glycol) is a $C_1$-$C_8$ (typically butanol) monocapped polyether (or glycol) selected from the following compositions:

(i) 0 wt % to 40 wt % ethylene oxide (or ethylene glycol); and 60 wt % to 100 wt % propylene oxide (or propylene glycol);

(ii) 0 wt % to 20 wt % ethylene oxide (or ethylene glycol); and 80 wt % to 100 wt % propylene oxide (or propylene glycol);

(iii) 0 wt % to 10 wt % ethylene oxide (or ethylene glycol); and 90 wt % to 100 wt % propylene oxide (or propylene glycol);

(iv) 100 wt % propylene oxide (or propylene glycol); and (v) a block A-B-A type copolymer comprising 30 wt % to 69 wt % propylene oxide (or propylene glycol); 1 wt % to 40 wt % ethylene oxide (ethylene glycol); and 30 wt % to 69 wt % propylene oxide (or propylene glycol).

The hydroxyl-terminated polyalkylene glycol may include homopolymers or copolymers of hydroxyl-terminated ethylene glycol, propylene glycol, butylene glycol, or mixtures thereof.

Examples of hydroxyl-terminated polyalkylene glycol include dihydroxyl-terminated polyalkylene glycol as well as monohydroxyl-terminated alkoxylated alcohols. Dihydroxyl-terminated polyalkylene glycol and monohydroxyl-terminated alkoxylated alcohols are known in the art and are commercially available from company such as BASF, Dow, Huntsman, and Sasol. For example, Dow sell products under the tradename of UCON™ OSP formulated fluids and lubricants and base stocks (see brochure entitled "UCON™ OSP Base Fluids, Oil-soluble polyalkylene glycol lubricant technology", Form Number 816-00039-0211X AMS, published February 2011). Dow also sell products under the tradename of UCON™ LB Fluids (advertised as LB Fluids are alcohol-started base stocks featuring oxypropylene groups (m=0) with one terminal hydroxyl group. They are water insoluble and available in a variety of molecular weights and viscosities), as well as SYNALOX® Fluids and Lubricants that may be useful too.

Without being bound by theory, it is believed that in one embodiment, the Lewis acid adduct of a polyether compound may be represented by formula:

$$M_x(PE)_nL_m$$

wherein M comprises one or more Lewis acids; PE is a hydroxide terminated polyether compound, the equivalent alkoxide, or mixtures thereof; L comprises compounds appropriate to satisfy the valence of the Lewis acid, the coordination sphere of the Lewis acid, or both; x is an integer from 1 to 4; n is an integer from 1 to 10; and m is an integer from 0 to 10. In one embodiment, the Lewis acid adduct is mononuclear (i.e. x is 1). In other embodiments, n is 1 to 6, or 1 to 4, or 2 to 4, or 4. In some embodiments, m is 0 to 4, or 0 to 2, or 0 or 2.

The Lewis acid (M) is as described above.

The polyether (PE) is as described above.

In the formula the compound L comprises materials which may function to coordinate with the Lewis acid to complete the coordination sphere or may function as counterions to balance any ionic charge. Suitable compounds include hydrocarbyl alcohols, hydrocarbyl alkoxides, hydroxides, halides (such as chloride bromide, iodide, or fluoride), hydrocarbyl carboxylates, and nitrates. In one embodiment, L may be a hydrocarbyl alkoxide of 1 to 18 carbon atoms, or 2 to 12 carbon atoms, or 4 to 8 carbon atoms.

L may be derived from alcohols such as methanol, ethanol, propanol, butanol, isopropanol, pentanol, hexanol, heptanol, 2-ethylhexanol, isooctanol, octanol, decoanol, dodecanol, tridecanol, tetradecanol, pentadecanol, hexadecanol, heptadecanol, octadecanol, or mixtures thereof.

Corrosion Inhibitor

In one embodiment the lubricating composition of the invention further comprises a corrosion inhibitor, typically a sulphur-containing corrosion inhibitor. When present the corrosion inhibitor may be present at 0.01 wt % to 5 wt %, or 0.05 wt % to 2 wt %, or 0.1 wt % to 1 wt %, or 0.2 wt % to 0.5 wt % of the lubricating composition.

The sulphur-containing corrosion inhibitor may include a thiadiazole, or a thiocarbonate, or a thiocarbamate, or mixtures thereof.

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-substituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units.

Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilised.

In one embodiment the thiadiazole compound includes at least one of 2,5-bis(tert-octyldithio)-1,3,4-thiadiazole, 2,5-bis(tert-nonyldithio)-1,3,4-thiadiazole, or 2,5-bis(tert-decyldithio)-1,3,4-thiadiazole.

The corrosion inhibitor may include an ashless thiocarbamate compound having an optionally-substituted hydrocarbyl group on an S-atom and an optionally-substituted hydrocarbyl group on an N-atom.

The ashless thiocarbamate compound having an optionally-substituted hydrocarbyl group on an S-atom and an optionally-substituted hydrocarbyl group on an N-atom may be represented by the formula:

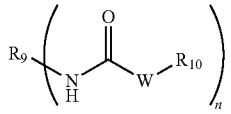

wherein n may be 1 or 2;

W may be oxygen or sulphur, provided that when n=1, W is sulphur, and when n=2, at least one W is sulphur;

$R_9$ may be an optionally-substituted hydrocarbyl group. $R_9$ may contain 2 to 60, or 4 to 30, or 6 to 20 carbon atoms, or a heterocycle (or substituted equivalents thereof), with the proviso that $R_9$ may be free of a nitrogen-containing heterocycle; and $R_{10}$ may be an optionally-substituted hydrocarbyl group or an optionally-substituted hydrocarbylene group [i.e., 2 points of attachment]. $R_{10}$ may contain 2 to 60, or 4 to 30, or 6 to 20 carbon atoms, or a heterocycle (or substituted equivalents thereof).

The ashless thiocarbamate compound having an optionally-substituted hydrocarbyl group on an S-atom and an optionally-substituted hydrocarbyl group on an N-atom may be represented by the formula:

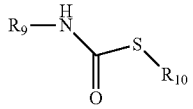

wherein $R_9$ may be an optionally-substituted hydrocarbyl group containing 2 to 60, or 4 to 30, or 6 to 20 carbon atoms, or a heterocycle (or substituted equivalents thereof); and $R_{10}$ may be a hydrocarbyl group containing 2 to 60, or 4 to 30, or 6 to 20 carbon atoms, or a heterocycle (or substituted equivalents thereof) with the proviso that $R_{10}$ (i.e., the S-hydrocarbyl atom) may be free of a nitrogen-containing heterocycle.

The ashless thiocarbamate compound having an optionally-substituted hydrocarbyl group on an S-atom and an optionally-substituted hydrocarbyl group on an N-atom may be represented by the formula:

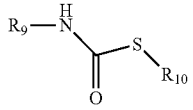

wherein $R_9$ may be an optionally-substituted hydrocarbyl group (typically a hydrocarbyl group containing 2 to 60, or 4 to 30, or 6 to 20 carbon atoms, or a heterocycle (or substituted equivalents thereof), with the proviso that $R_9$ may be free of a nitrogen-containing heterocycle); and $R_{10}$ may be an optionally substituted hydrocarbyl group (typically a hydrocarbyl group containing 2 to 60, or 4 to 30, or 6 to 20 carbon atoms, or a heterocycle (or substituted equivalents thereof) with the proviso that $R_{10}$ (i.e., the S-hydrocarbyl atom) may be free of a nitrogen-containing heterocycle.

The ashless thiocarbamate compound having an optionally-substituted hydrocarbyl group on an S-atom and an optionally-substituted hydrocarbyl group on an N-atom may be represented by the formula:

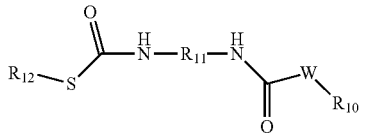

wherein

W may be >0, or >S, or >NH or >$NR_{13}$ (typically W may be >0, or >S);

$R_{10}$ may be a hydrocarbyl group containing 2 to 60, or 4 to 30, or 6 to 20 carbon atoms, or a heterocycle (or substituted equivalents thereof) with the proviso that $R_{10}$ (i.e., the S-hydrocarbyl atom) may be free of a nitrogen-containing heterocycle;

$R_{11}$ may be a hydrocarbylene group (typically containing 1 to 16, or 2 to 10, or 4 to 8, such as 6 carbon atoms), or a heterocycle (or substituted equivalents thereof);

$R_{12}$ may be a hydrocarbyl group containing 2 to 60, or 4 to 30, or 6 to 20 carbon atoms, or a heterocycle (or substituted equivalents thereof); and $R_{13}$ may be a hydrocarbyl group containing 1 to 30, or 1 to 20, or 1 to 10, or 1 to 5 carbon atoms.

$R_{11}$ may be a linear, branched or cyclic group. If $R_{11}$ is cyclic, it may be aromatic or non-aromatic.

The ashless thiocarbamate compound having an optionally-substituted hydrocarbyl group on an S-atom and an optionally-substituted hydrocarbyl group on an N-atom may contain one or more linear hydrocarbyl groups.

The ashless thiocarbamate compound having an optionally-substituted hydrocarbyl group on an S-atom and an optionally-substituted hydrocarbyl group on an N-atom may contain one linear hydrocarbyl group and one branched hydrocarbyl group. The branched hydrocarbyl group may be an α-branched hydrocarbyl group, or a β-hydrocarbyl group. The branched hydrocarbyl group may, for instance, be a 2-ethylhexyl group.

The ashless thiocarbamate compound having an optionally-substituted hydrocarbyl group on an S-atom and an optionally-substituted hydrocarbyl group on an N-atom may contain one or more cyclic hydrocarbyl groups.

A cyclic hydrocarbyl group may be aromatic or non-aromatic. The cyclic hydrocarbyl group may be a heterocycle or a non-heterocycle.

A non-aromatic hydrocarbyl group may include a cycloalkane, or a pyrrolidinone. Typically, the non-aromatic hydrocarbyl group may be cyclohexane or pyrrolidinone.

As used herein reference to "a" specific compound such as "a pyrrole", or "a pyrrolidine" and so on is intended to include both the chemical itself (i.e., pyrrole, pyrrolidine), and their substituted equivalents thereof.

A non-heterocycle may include a phenyl group, or a naphthalyl group.

A heterocycle may for instance include a pyrrole, a pyrrolidine, a pyrrolidinone, a pyridine, a piperidine, a pyrone, a pyrazole, a pyrazine, pyridazine, a 1,2-diazole, a 1,3-diazole, a 1,2,4-triazole, a benzotriazole, a quinoline, an indole, an imidazole, an oxazole, an oxazoline, a thiazole, a thiophene, an indolizine, a pyrimidine, a triazine, a furan, a tetrahydrofuran, a dihydrofuran, or mixtures thereof.

In one embodiment the heterocycle may be a tetrazole, or a triazole (either a 1,2,4-triazole, or a benzotriazole), or a pyridine.

The ashless thiocarbamate compound having an optionally-substituted hydrocarbyl group on an S-atom and an optionally-substituted hydrocarbyl group on an N-atom may contain one cyclic hydrocarbyl group and one linear hydrocarbyl group.

The ashless thiocarbamate compound having an optionally-substituted hydrocarbyl group on an S-atom and an optionally-substituted-hydrocarbyl group on an N-atom may contain one heterocyclic hydrocarbyl group and one linear hydrocarbyl group.

The ashless thiocarbamate compound having an optionally-substituted hydrocarbyl group on an S-atom and an optionally-substituted hydrocarbyl group on an N-atom may be halogen free.

The ashless thiocarbamate compound having an optionally-substituted hydrocarbyl group on an S-atom and an optionally-substituted hydrocarbyl group on an N-atom may be prepared by a process comprising reacting (i) a hydrocarbyl-substituted isocyanate or a hydrocarbyl-substituted diisocyanate, and (ii) a hydrocarbyl-substituted thiol, optionally in presence of a heterocycle.

The mole ratio of hydrocarbyl-substituted thiol to either the hydrocarbyl-substituted isocyanate or the hydrocarbyl-substituted diisocyanate may vary from 0.5:1 to 3:1, typically 1:1 or 1:2. For a monoisocyanate, the mole ratio may be 0.5:1 to 1.5:1. For a diisocyanate, the mole ratio may be 1:1 to 3:1.

The reaction to prepare the ashless thiocarbamate compound having an optionally-substituted hydrocarbyl group on an S-atom and an optionally-substituted hydrocarbyl group on an N-atom may be carried out at a temperature in the range of 0° C. to 150° C., or 20° C. to 80° C., or 25° C. to 50° C., optionally in the presence of a solvent and optionally in the presence of a catalyst. In one embodiment the reaction may be carried out in the presence of a catalyst. In one embodiment the reaction may be carried out in the presence of one or more solvents.

The reaction to prepare the ashless thiocarbamate compound having an optionally-substituted hydrocarbyl group on an S-atom and an optionally-substituted hydrocarbyl group on an N-atom may be carried out in an inert atmosphere or in air. The inert atmosphere may be a nitrogen or argon atmosphere (typically nitrogen).

The solvent may include a polar or non-polar medium. The solvent may for instance include acetone, toluene, xylene, tetrahydrofuran, diluent oil, Acetonitrile, N,N-dimethyl formamide, N,N-dimethyl acetamide, methyl ether ketone, t-butylmethyl ether, dimethoxy ethane, dichloromethane, or dichloroethane, or mixtures thereof.

The catalyst may be a tertiary amine such as tri-$C_{1-5}$-alkyl amine (typically triethylamine), tripropylamine, tributylamine, or diisopropylethylamine, or mixtures thereof.

The hydrocarbyl-substituted thiol (may also be referred to as a mercaptan) may have the hydrocarbyl group defined the same as $R_{10}$ above (that is to say the hydrocarbyl group may contain 2 to 60, or 4 to 30, or 6 to 20 carbon atoms). Examples of a hydrocarbyl-substituted thiol include ethyl thiol, butyl thiol, hexyl thiol, heptyl thiol, octyl thiol, 2-ethylhexyl thiol, nonyl thiol, decyl thiol, undecyl thiol, dodecyl thiol, tridecyl thiol, butadecyl thiol, pentadecyl thiol, hexadecyl thiol, heptadecyl thiol, octadecyl thiol, nonadecyl thiol, eicosyl thiol, or mixtures thereof.

The hydrocarbyl-substituted isocyanate may have the optionally-substituted hydrocarbyl group defined the same as $R_9$ above (that is to say the hydrocarbyl group may contain 2 to 60, or 4 to 30, or 6 to 20 carbon atoms). Examples of a hydrocarbyl-substituted isocyanate include cyclohexyl isocyanate, methyl isocyanate, ethyl isocyanate, propyl isocyanate, butyl isocyanate, pentylisocyanate, hexylisocyanate, heptylisocyanate, octylisocyanate, nonylisocyanate, decylisocyanate, undecyl isocyanate, dodecyl isocyanate, tridecyl isocyanate, tetradecyl isocyanate, pentadecyl isocyanate, hexadecyl isocyanate, heptadecyl isocyante, ocatadecyl isocyanate, nonadecyl isocyanate, allyl isocyanate, phenyl isocyanate, and its derivatives, such as benzyl isocyanate, tolyl isocyanate, ethylphenyl isocyanate, chlorophenyl isocyanate, or naphthyl isocyanate.

The hydrocarbyl-substituted diisocyanate may have the hydrocarbylene group defined the same as $R_{11}$ (that is to say the hydrocarbylene group may contain 1 to 16, or 2 to 10, or 4 to 8, such as 6 carbon atoms). Examples of a hydrocarbyl-substituted diisocyanate include isophorone diisocyanate, methylene-di-p-phenyl-diisocyanate, methylenediisocyanate, ethylenediisocyanate, diisocyanatobutane, diisocyanatohexane, cyclohexylene diisocyanate, toluene diisocyanate.

The hydrocarbyl-substituted diisocyanate may also have $R_{12}$ defined the same as $R_{10}$.

The hydrocarbyl-substituted diisocyanate compound may also be partially reacted with a hydrocarbyl-substituted thiol. Partial reaction may occur when there is a mole excess of the hydrocarbyl-substituted diisocyanate. In this situation, the product of reacting the hydrocarbyl-substituted diisocyanate with the hydrocarbyl-substituted thiol may be represented by when W is >O.

In one embodiment the present invention provides a lubricating composition comprising: an oil of lubricating viscosity, a reaction product of a monovalent to tetravalent inorganic Lewis acid and a hydroxyl terminated polyether (or glycol), wherein the mole ratio of hydroxyl terminated polyether (or glycol) to Lewis acid is 1:1 or greater, and a corrosion inhibitor, wherein the inorganic Lewis acid comprises boron, and the corrosion inhibitor comprises an ashless thiocarbamate compound having an optionally-substituted hydrocarbyl group on an S-atom and an optionally-substituted hydrocarbyl group on an N-atom may be represented by the formulae above.

Oils of Lubricating Viscosity

The lubricating composition of the present invention also contains an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10). In one embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Overbased Detergent

In one embodiment the lubricating composition of the invention further comprises an overbased metal-containing detergent, or mixtures thereof. The overbased metal-containing detergent may be selected from the group consisting of non-sulphur containing phenates, sulphur containing phenates, sulphonates, salixarates, salicylates, and mixtures thereof, or borated equivalents thereof. The overbased detergent may be borated with a borating agent such as boric acid.

The overbased detergent may be selected from the group consisting of non-sulphur containing phenates, sulphur containing phenates, sulphonates, salixarates, salicylates, and mixtures thereof.

The overbased detergent may be non-sulphur containing phenates, sulphur containing phenates, sulphonates.

The metal of the metal-containing detergent may be an alkali metal, an alkaline earth metal, or zinc. In one embodiment the metal is sodium, calcium, barium, or magnesium. Typically the metal of the metal-containing detergent may be sodium, calcium, or magnesium.

Typically the overbased metal-containing detergent may be a calcium or magnesium overbased detergent.

The overbased metal-containing detergent may also include "hybrid" detergents formed with mixed surfactant systems including phenate and/or sulphonate components, e.g., phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased detergent may be sodium, calcium or magnesium salt of the phenates, sulphur containing phenates, sulphonates, salixarates and salicylates. Overbased phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. In one embodiment the sulphonate detergent may be a metal salt of one or more oil-soluble alkyl toluene sulphonate compounds as disclosed in paragraphs [0046] to [0053] of US Patent Application 2008/0119378.

Overbased detergents are known in the art. Overbased materials, otherwise referred to as overbased or superbased salts, are generally single phase, homogeneous systems characterised by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of "excess"

metal (stoichiometrically) is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio is also explained in standard textbook entitled "Chemistry and Technology of Lubricants", Third Edition, Edited by R. M. Mortier and S. T. Orszulik, Copyright 2010, page 219, sub-heading 7.25.

The overbased detergent may be present at 0 wt % to 10 wt %, or 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition. In one embodiment, an engine lubricating composition comprises at least one overbased detergent with a metal ratio of at least 3, or at least 8, or at least 15.

Other Performance Additives

A lubricating composition may be prepared by adding the polyether and overbased detergent described herein above to an oil of lubricating viscosity, optionally in the presence of other performance additives (as described herein below).

The lubricating composition of the invention may further include other additives. In one embodiment the invention provides a lubricating composition further comprising at least one of a dispersant, an antiwear agent, a dispersant viscosity modifier, a friction modifier, a viscosity modifier, an antioxidant, an overbased detergent, a foam inhibitor, a demulsifier, a pour point depressant or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

The lubricating composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the invention does include a dispersant or mixtures thereof. The dispersant may be present as a single dispersant. The dispersant may be present as a mixture of two or more (typically two or three) different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetra-ethylenepentamine, pentaethylenehexamine, polyamine still bottoms, and mixtures thereof.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, typically diethyleneamine).

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in US Patent Application US2009/0054278.

In one embodiment the dispersant may be borated or non-borated. Typically a borated dispersant may be a succinimide dispersant. In one embodiment, the ashless dispersant is boron-containing, i.e., has incorporated boron and delivers said boron to the lubricant composition. The boron-containing dispersant may be present in an amount to deliver at least 25 ppm boron, at least 50 ppm boron, or at least 100 ppm boron to the lubricant composition. In one embodiment, the lubricant composition is free of a boron-containing dispersant, i.e. delivers no more than 10 ppm boron to the final formulation.

The dispersant may be prepared/obtained/obtainable from reaction of succinic anhydride by an "ene" or "thermal" reaction, by what is referred to as a "direct alkylation process." The "ene" reaction mechanism and general reaction conditions are summarised in "Maleic Anhydride", pages, 147-149, Edited by B. C. Trivedi and B. C. Culbertson and Published by Plenum Press in 1982. The dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The dispersant may also be obtained/obtainable from a chlorine-assisted process, often involving Diels-Alder chemistry, leading to formation of carbocyclic linkages. The process is known to a person skilled in the art. The chlorine-assisted process may produce a dispersant that is a polyisobutylene succinimide having a carbocyclic ring present on 50 mole % or more, or 60 to 100 mole % of the dispersant molecules. Both the thermal and chlorine-assisted processes are described in greater detail in U.S. Pat. No. 7,615,521, columns 4-5 and preparative examples A and B.

The dispersant may have a carbonyl to nitrogen ratio (CO:N ratio) of 5:1 to 1:10, 2:1 to 1:10, or 2:1 to 1:5, or 2:1 to 1:2. In one embodiment the dispersant may have a CO:N ratio of 2:1 to 1:10, or 2:1 to 1:5, or 2:1 to 1:2, or 1:1.4 to 1:0.6.

The dispersant may be present at 0 wt % to 20 wt %, 0.1 wt % to 15 wt %, or 0.5 wt % to 9 wt %, or 1 wt % to 8.5 wt % of the lubricating composition.

In one embodiment the lubricating composition may be a lubricating composition further comprising a molybdenum compound. The molybdenum compound may be an antiwear agent or an antioxidant. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

Antioxidants include sulphurised olefins, diarylamines, alkylated diarylamines, hindered phenols, molybdenum compounds (such as molybdenum dithiocarbamates), hydroxyl thioethers, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butyl-phenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates, which may be used as an antioxidant, include commercial materials sold under the trade names such as Vanlube 822™ and Molyvan™ A from R. T. Vanderbilt Co., Ltd., and Adeka Sakura-Lube™ S-100, S-165, S-600 and 525, or mixtures thereof.

In one embodiment the lubricating composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The dispersant viscosity modifier may include functionalised polyolefins, for example, ethylene-propylene copolymers that have been functionalised with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; 6,117,825; and U.S. Pat. No. 7,790,661. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]). In one embodiment the dispersant viscosity modifier may include those described in U.S. Pat. No. 7,790,661 column 2, line 48 to column 10, line 38.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt %, or 0.2 wt % to 1.2 wt % of the lubricating composition.

In one embodiment the friction modifier may be selected from the group consisting of long chain fatty acid derivatives of amines, long chain fatty esters, or derivatives of long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulphurised fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a triglyceride.

The lubricating composition optionally further includes at least one antiwear agent. Examples of suitable antiwear agents include titanium compounds, tartaric acid derivatives such as tartrate esters, amides or tartrimides, oil soluble amine salts of phosphorus compounds, sulphurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulphides.

The antiwear agent may in one embodiment include a tartrate or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

The lubricating composition may further include a phosphorus-containing antiwear agent. Typically the phosphorus-containing antiwear agent may be a zinc dialkyldithiophosphate, phosphite, phosphate, phosphonate, and ammonium phosphate salts, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

In one embodiment, the oil soluble titanium compound is a titanium carboxylate. In one embodiment the titanium (IV) carboxylate is titanium neodecanoate.

Foam inhibitors that may be useful in the compositions of the invention include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof different from the non-hydroxy terminated acylated polyether of the invention.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulpholene derivatives Exxon Necton37™ (FN 1380) and Exxon Mineral Seal Oil™ (FN 3200).

An engine lubricating composition in different embodiments may have a composition as disclosed in the following table:

| | Embodiments (wt %) | | |
|---|---|---|---|
| Additive | A | B | C |
| Reaction Product* | 0.05 to 3 | 0.1 to 2 | 0.2 to 1.5 |
| Corrosion Inhibitor | 0.05 to 2 | 0.1 to 1 | 0.2 to 0.5 |
| Overbased Detergent | 2 to 9 | 3 to 8 | 3 to 5 |
| Dispersant Viscosity Modifier | 0 to 5 | 0 to 4 | 0.05 to 2 |
| Dispersant | 0 to 12 | 0 to 8 | 0.5 to 6 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

Footnote:

*Reaction Product is the a reaction product of a monovalent to tetravalent inorganic Lewis acid and a hydroxyl terminated polyether (or glycol)

INDUSTRIAL APPLICATION

In one embodiment the invention provides a method of lubricating an internal combustion engine. The engine components may have a surface of steel or aluminium.

An aluminium surface may be derived from an aluminium alloy that may be a eutectic or a hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an exhaust gas recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine, a mixed gasoline/alcohol fuelled engine, or a hydrogen fuelled internal combustion engine. In one embodiment the internal combustion engine may be a diesel fuelled engine and in another embodiment a gasoline fuelled engine. In one embodiment the internal combustion engine may be a heavy duty diesel engine. In one embodiment the internal combustion engine may be a gasoline engine such as a gasoline direct injection engine.

The internal combustion engine may be a 2-stroke or 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine). In one embodiment the internal combustion engine is a 4-stroke engine.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. The total sulphated ash content may be 0.3 wt % to 1.2 wt %, or 0.5 wt % to 1.2 wt % or 1.1 wt % of the lubricating composition. In one embodiment the sulphated ash content may be 0.5 wt % to 1.2 wt % of the lubricating composition.

In one embodiment the lubricating composition may be an engine oil, wherein the lubricating composition may be characterised as having at least one of (i) a sulphur content of 0.5 wt % or less, (ii) a phosphorus content of 0.12 wt % or less, and (iii) a sulphated ash content of 0.5 wt % to 1.1 wt % of the lubricating composition.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

The following examples provide illustrations of the invention. These examples are non-exhaustive and are not intended to limit the scope of the invention.

EXAMPLES

General Procedure for the Preparation of Borate Esters or Titanate Esters:

A 250 mL 3-necked RB flask outfitted with magnetic stirrer, water condenser, thermocouple, Dean-Stark trap and nitrogen inlet was charged with either: titanium (IV) butoxide/boron tributoxide and a polyalkylene glycol reagent. The mixture is stirred under nitrogen at 180° C. for 6 hours, during which time 1-butanol is collected in the Dean-Stark trap. The reaction is stopped and the mixture is concentrated under reduced pressure to remove 1-butanol residues. The resulting material is collected. ADD A: Adduct of one equivalent of boron and three equivalents of the alkoxide (derived from Synalox® 100-120B polyalkylene glycol). The Synalox polyalkylene glycol (available from Dow Chemical) is a polymer of propylene glycol with a number averaged molecular weight of approximately 2000, and the polymer has a hydroxy-end group, and n-butylether end group.

ADD B: Adduct of one equivalent of titanium(IV) and four equivalents of the alkoxide (derived from Synalox® 100-120B polyalkylene glycol). The Synalox polyalkylene glycol is a polymer of propylene glycol with a number averaged molecular weight of approximately 2000, and the polymer has a hydroxy-end group, and n-butylether end group.

ADD C. Adduct of one equivalent of boron and three equivalents of the alkoxide (derived from Brij® 93 polyalkylene glycol). The Brij polyalkylene glycol (available from Aldrich Chemicals) is an oligomer of ethylene glycol with a number averaged molecular weight of approximately 357, and the oligomer has a hydroxy-end group, and oleylether end group.

Additional examples demonstrating still further embodiments of the invention are also included. These materials are prepared in a similar fashion as above with the ratio of polyalkylene glycol adjusted as necessary to prepare the described materials. All of the preparative examples are summarized in the following table:

| Example | Lewis Acid (M) | PAG (PE) | Alkoxide (L) | M:PAG:L |
|---|---|---|---|---|
| ADD D | B | PPO[1] | — | 1:3:0 |
| ADD E | Ti | PPO | — | 1:4:0 |
| ADD F | B | Brij 97[2] | — | 1:3:0 |
| ADD G | B | Brij 98[3] | — | 1:3:0 |
| ADD H | B | Brij 56[4] | — | 1:3:0 |
| ADD I | Ti | Brij 98 | — | 1:4:0 |
| ADD J | Ti | Brij 97 | — | 1:4:0 |
| ADD K | Ti | Brij 93 | — | 1:4:0 |
| ADD L | Ti | Brij 56 | — | 1:4:0 |
| ADD M | B | PPO | n-Butyl | 1:2:2 |
| ADD N | B | Synalox 100-120B | n-Butyl | 1:2:1 |
| ADD P | Ti | Synalox 100-120B | n-Butyl | 1:3:1 |
| ADD Q | Ti | Synalox 100-120B | n-Butyl | 1:2:2 |
| ADD R | Ti | Synalox 100-120B | n-Butyl | 1:1:3 |
| ADD S | Ti | PPO | n-Butyl | 1:3:1 |
| ADD T | Ti | PPO | n-Butyl | 1:2:2 |
| ADD U | Ti | PPO | n-Butyl | 1:1:3 |

[1]PPO is a polypropylene oxide with Mn of approximately 1400, with monohydric end-group and C12-15 alkyl ether end-group.
[2]Brij 97 is a polyethylene oxide with Mn of 709, with monohydric end-group and oleyl ether end-group.
[3]Brij 98 is a polyethylene oxide with Mn of 1150, with monohydric end-group and oleyl ether end-group
[4]Brij 56 is a polyethylene oxide with Mn of 680, with monohydric end-group and hexadecyl ether end-group General Procedure for the Preparation of Thiocarbamate:

To a 4-necked 5000 mL round bottom flask equipped with a mechanical stirrer, thermowell, nitrogen inlet, and friedrich's condenser is added isocyanate and toluene. The reaction is capped with nitrogen, and stirred moderately. To the solution is added catalytic amount of triethyl amine. Then mercaptan is added dropwise over a period of time. The mercaptan is added at a rate to ensure the exotherm is controlled. The solution is heated to 65° C. and held with stirring for 2 hours. The reaction is monitored by IR analysis until the IR spectra remains unchanged. The solvent is stripped under vacuum to afford final product as white solid.

ADD X. $PhNHCOSC_{12}H_{25}$-reaction product of 1 equivalent of phenylisocynate and 1 equivalent of 1-dodecyl mercaptan.

A set of 5W-30 engine lubricants in Group III base oil of lubricating viscosity are prepared containing the additives described above as well as conventional additives including polymeric viscosity modifier, ashless succinimide dispersant, overbased detergents, antioxidants (combination of phenolic ester, diarylamine, and sulfurized olefin), zinc dialkyldithiophosphate (ZDDP), as well as other performance additives as follows (Table 1).

TABLE 1

Lubricating Oil Composition Formulations

| | Baseline | Comparative Example 1 | Example 1 |
|---|---|---|---|
| Group II Base Oil | Balance to 100% | Balance to 100% | Balance to 100% |
| Synalox ® 100-120B | | 0.3 | |
| ADD A | | | 0.3 |
| Calcium containing detergent | 1.45 | 1.45 | 1.45 |
| Zinc dialkyldithiophosphate | 0.5 | 0.5 | 0.5 |
| Antioxidant | 2 | 2 | 2 |
| Active Dispersant | 4.9 | 4.9 | 4.9 |
| Viscosity Modifier[5] | 1.2 | 1.2 | 1.2 |
| Additional additives[6] | 0.36 | 0.36 | 0.36 |
| Phosphorus | 450 ppm | 450 ppm | 450 ppm |
| % Sulfur | 0.18 | 0.18 | 0.18 |

The formulations were evaluated in deposit bench Thermo-oxidation Engine Oil Simulation Test TEOST 33C described in ASTM D6335. The results are summarized in Table 2.

TABLE 2

| Deposit Bench Test D6335 | | | |
|---|---|---|---|
| | Baseline | Comparative Example 1 | Example 1 |
| TEOST 33C | 17.7 mg | 17 mg | 13.2 mg |

The result indicated that the addition of 0.3% ADD A to the baseline provided a significant deposit control boost comparing with the baseline and comparative example 1, which contains 0.3% of the polyalkylene glycol of the invention.

Another set of 5W-30 engine lubricants in Group III base oil of lubricating viscosity are prepared containing the additives described above as well as conventional additives including polymeric viscosity modifier, ashless succinimide dispersant, overbased detergents, antioxidants (combination of phenolic ester, diarylamine, and sulfurized olefin), zinc dialkyldithiophosphate (ZDDP), as well as other performance additives as follows (Table 3).

TABLE 3

| Lubricating Oil Composition Formulations | | | |
|---|---|---|---|
| | Baseline | Comparative Example 2 | Example 2 |
| Group II Base Oil | Balance to 100% | Balance to 100% | Balance to 100% |
| Synalox ® 100-120B | | 0.2 | |
| ADD B | | | 0.2 |
| Calcium containing detergent | 1.45 | 1.45 | 1.45 |
| Zinc dialkyldithiophosphate | 0.45 | 0.45 | 0.45 |
| Antioxidant | 2 | 2 | 2 |
| Active Dispersant | 4.9 | 4.9 | 4.9 |
| Viscosity Modifier | 1.23 | 1.23 | 1.23 |
| Additional additives | 0.36 | 0.36 | 0.36 |
| Phosphorus | 450 ppm | 450 ppm | 450 ppm |
| % Sulfur | 0.18 | 0.18 | 0.18 |

The formulations were evaluated in deposit bench Thermo-oxidation Engine Oil Simulation Test TEOST 33C using ASTM D6335. The results are summarized in Table 4.

TABLE 4

| Deposit Bench Test D6335 | | | |
|---|---|---|---|
| | Baseline | Comparative Example 2 | Example 2 |
| TEOST 33C | 17.7 mg | 15.7 mg | 14.3 mg |

The result indicated that the addition of 0.2% ADD B to the baseline provided a significant deposit control boost comparing with the baseline and comparative example 2, which contains 0.2% polyalkylene glycol or the invention.

Another set of 15W-40 engine lubricants in Group II base oil of lubricating viscosity are prepared containing the additives described above as well as conventional additives including polymeric viscosity modifier, ashless succinimide dispersant, overbased detergents, antioxidants (combination of phenolic ester, diarylamine, and sulfurized olefin), zinc dialkyldithiophosphate (ZDDP), as well as other performance additives as follows (Table 5).

TABLE 5

| Lubricating Oil Composition Formulations | | | |
|---|---|---|---|
| | Baseline 2 | Example 3 | Example 4 |
| Group II Base Oil | Balance to 100% | Balance to 100% | Balance to 100% |
| ADD C | | 0.3 | 0.6 |
| Calcium containing detergent | 1.73 | 1.73 | 1.73 |
| Zinc dialkyldithiophosphate | 1.09 | 1.09 | 1.09 |
| Antioxidant | 1.23 | 1.23 | 1.23 |
| Active Dispersant | 4.76 | 4.76 | 4.76 |
| Viscosity Modifier | 0.56 | 0.56 | 0.56 |
| Additional additives | 1.16 | 1.16 | 1.16 |
| % Phosphorus | 0.11 | 0.11 | 0.11 |
| % Sulfur | 0.35 | 0.35 | 0.35 |

TABLE 6

| Modified High Temperature Corrosion Bench Test | | | |
|---|---|---|---|
| | Baseline 2 | Example 3 | Example 4 |
| Cu ppm | 179 | 124 | 82 |

The result indicated that the addition of 0.3% and 0.6% ADD C to the baseline significantly reduced copper corrosion compared to a baseline that does not contain ADD C.

Another set of 15W-40 engine lubricants in Group II base oil of lubricating viscosity are prepared containing the additives described above as well as conventional additives including polymeric viscosity modifier, ashless succinimide dispersant, overbased detergents, antioxidants (combination of phenolic ester, diarylamine, and sulfurized olefin), zinc dialkyldithiophosphate (ZDDP), as well as other performance additives as follows (Table 7).

TABLE 7

| Lubricating Oil Composition Formulations | | | |
|---|---|---|---|
| | Baseline 2 | Example 5 | Example 6 |
| Group II Base Oil | Balance to 100% | Balance to 100% | Balance to 100% |
| ADD X | | | 0.85 |
| ADD C | | 0.1 | 0.1 |
| Calcium containing detergent | 1.73 | 1.73 | 1.73 |
| Zinc dialkyldithiophosphate | 1.09 | 1.09 | 1.09 |
| Antioxidant | 1.23 | 1.23 | 1.23 |
| Active Dispersant | 4.76 | 4.76 | 4.76 |
| Viscosity Modifier | 0.56 | 0.56 | 0.56 |
| Additional additives | 1.16 | 1.16 | 1.16 |
| % Phosphorus | 0.11 | 0.11 | 0.11 |
| % Sulfur | 0.35 | 0.35 | 0.35 |

The formulations were evaluated in Modified High Temperature Corrosion Bench Test HTCBT. The results are summarized in Table 8.

TABLE 6

| Modified High Temperature Corrosion Bench Test | | | |
|---|---|---|---|
| | Baseline 2 | Example 5 | Example 6 |
| Cu ppm | 179 | 211 | 132 |
| Pb ppm | 107 | 24 | 30 |

The result indicated that the addition of 0.1% ADD C significantly reduced Pb corrosion comparing with the baseline 2. However, this was accompanied by an increase of Cu corrosion over the baseline. The addition of both 0.1% ADD C and 0.85% ADD X reduced both Cu and Pb corrosion compared to baseline formulation 2.

The results indicate that a lubricating composition disclosed herein is able to provide at least one of (i) improved sludge handling, (ii) reduced lead or copper corrosion, (iii) increased oxidation resistance, and/or (iv) decreased deposit formation in an internal combustion engine.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising;

a. an oil of lubricating viscosity, and b. a reaction product of a Lewis acid comprising a tetravalent D-block transition metal and a hydroxyl terminated polyether, wherein the mole ratio of the hydroxyl terminated polyether to the inorganic Lewis acid is 1:1 or greater.

2. The lubricating composition of claim 1 wherein the reaction product is represented by the formula $M_x(PE)_nL_m$ wherein:

M is the inorganic Lewis acid, x is 1,

PE is selected from the group consisting of a hydroxide terminated polyether, an alkoxide terminated polyether and blends thereof, n is 1 to 4, L is selected from the group consisting of hydrocarbyl alcohols, hydrocarbyl alkoxides, hydroxides, halides, hydrocarbyl carboxylates and nitrates, and m is 4-n.

3. The lubricating composition of claim 2, wherein M comprises at least one of titanium, chromium, iron, copper, or zinc.

4. The lubricating composition of claim 1, wherein the reaction product is present at 0.05 wt % to 5 wt % of the lubricating composition.

5. The lubricating composition of claim 1, wherein the hydroxyl terminated polyether is a homopolymer or a copolymer.

6. The lubricating composition of claim 5 wherein the hydroxyl terminated polyether is a copolymer comprising (i) 0.1 wt % to 80 wt % with respect to the hydroxyl terminated polyether of ethylene glycol or its oxide, and (ii) 20 wt % to 99.9 wt % of an alkylene glycol or its oxide containing 3 to 8 carbon atoms.

7. The lubricating composition of claim 1, wherein the hydroxyl terminated polyether is a copolymer according to Formula I:

Formula I

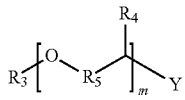

wherein:

$R_3$ is hydrogen (H), —$R_6$OH, —$R_6NH_2$, —(C═O)$R_6$, —$R_6$—N(H)C(═O)$R_6$, or a hydrocarbyl group of from 1 to 30, or 1 to 20, or 1 to 15 carbon atoms, each $R_4$ is independently selected from H, or a hydrocarbyl group of from 1 to 10 carbon atoms, each $R_5$ is independently selected from a straight or branched hydrocarbyl group of from 1 to 6 carbon atoms, $R_6$ is a hydrocarbyl group of 1 to 20 carbon atoms, Y is —$NR_7R_8$, —OH, —$R_6NH_2$ or —$R_6$OH, $R_7$, and $R_8$, independently, is H, or a hydrocarbyl group of from 1 to 50 carbon atoms in which up to one third of the carbon atoms is substituted by N or functionalized with additional polyether of Formula I, and m is an integer from 2 to 50, with the proviso that at least one of $R_3$ or Y is selected to form a terminal hydroxyl group.

8. The lubricating composition of claim 1 further comprising a corrosion inhibitor.

9. The lubricating composition of claim 8, wherein the corrosion inhibitor comprises a sulphur-containing corrosion inhibitor.

10. The lubricating composition of claim 9, wherein the sulphur-containing corrosion inhibitor comprises an ashless thiocarbamate compound having an optionally-substituted hydrocarbyl group on an S-atom and an optionally-substituted hydrocarbyl group on an N-atom.

11. The lubricating composition of claim 10, wherein the sulphur-containing corrosion inhibitor comprises an ashless thiocarbamate compound having an optionally-substituted hydrocarbyl group on an S-atom and an optionally-substituted hydrocarbyl group on an N-atom represented by the formula:

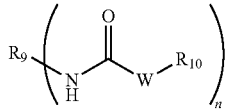

wherein n is 1 or 2;

W is oxygen or sulphur, provided that when n=1, W is sulphur, and when n=2, at least one W is sulphur;

$R_9$ is an optionally-substituted hydrocarbyl group, with the proviso that $R_9$ is free of a nitrogen-containing heterocycle; and $R_{10}$ is an optionally-substituted hydrocarbyl group or an optionally-substituted hydrocarbylene group.

12. The lubricating composition of claim 8, wherein the corrosion inhibitor is present at 0.01 wt % to 5 wt % of the lubricating composition.

13. The lubricating composition of claim 1, further comprising an overbased detergent.

14. The lubricating composition of claim 13, further comprising a sulphur-containing corrosion inhibitor, wherein the sulphur-containing corrosion inhibitor comprises an ashless thiocarbamate compound having an optionally-substituted hydrocarbyl group on an S-atom and an optionally-substituted hydrocarbyl group on an N-atom.

15. The lubricating composition of claim 3, wherein M comprises titanium.

* * * * *